US011365957B2

(12) United States Patent
Hucker

(10) Patent No.: US 11,365,957 B2
(45) Date of Patent: Jun. 21, 2022

(54) FUZE SYSTEM

(71) Applicant: BAE SYSTEMS plc, London (GB)

(72) Inventor: Martyn John Hucker, Monmouthshire (GB)

(73) Assignee: BAE SYSTEMS PLC, London (GB)

( * ) Notice: Subject to any disclaimer, the term of this patent is extended or adjusted under 35 U.S.C. 154(b) by 189 days.

(21) Appl. No.: 16/483,299

(22) PCT Filed: Feb. 1, 2018

(86) PCT No.: PCT/GB2018/050291

§ 371 (c)(1),
(2) Date: Aug. 2, 2019

(87) PCT Pub. No.: WO2018/146457

PCT Pub. Date: Aug. 16, 2018

(65) Prior Publication Data

US 2020/0003534 A1 Jan. 2, 2020

(30) Foreign Application Priority Data

Feb. 9, 2017 (EP) ..... 17275014
Feb. 9, 2017 (GB) ..... 1702119

(51) Int. Cl.
*F42C 11/00* (2006.01)
*F42C 15/40* (2006.01)
*F42C 17/04* (2006.01)

(52) U.S. Cl.
CPC ..... *F42C 11/008* (2013.01); *F42C 15/40* (2013.01); *F42C 17/04* (2013.01)

(58) Field of Classification Search
CPC ... F42C 15/40; F42C 17/04; F42C 11/00–065
See application file for complete search history.

(56) References Cited

U.S. PATENT DOCUMENTS 3,554,129 A 1/1971 Alpers
4,015,530 A * 4/1977 Dick ..... F42C 13/02 102/213

(Continued)

FOREIGN PATENT DOCUMENTS

GB 2198815 A * 6/1988 ..... F42C 17/04
WO WO-8404157 A1 * 10/1984 ..... F42C 17/04
WO 2018146457 A1 8/2018

OTHER PUBLICATIONS

International Preliminary Report on Patentability received for PCT Application No. PCT/GB2018/050291. Dated Aug. 13, 2019. 9 pages.

(Continued)

*Primary Examiner* — Gabriel J. Klein
(74) *Attorney, Agent, or Firm* — Finch & Maloney PLLC

(57) ABSTRACT

According to a first aspect of the present invention, there is provided a fuse system (22) for a munitions projectile, the system comprising: a first electro-optic transmitter (24); a first electro-optic receiver (30); the first electro-optic transmitter (24) being arranged to receive electrical power, and to use that received electrical power to transmit an optical signal (28) to the first electro-optic receiver (30); the first electro-optic receiver (30) being arranged to receive the optical signal (28), and to use that received optical signal (28) to transmit electrical power to an element (34) of the fuse system (22) connected to the first electro-optic receiver (30).

16 Claims, 4 Drawing Sheets

(56) References Cited

U.S. PATENT DOCUMENTS

Figure 1:
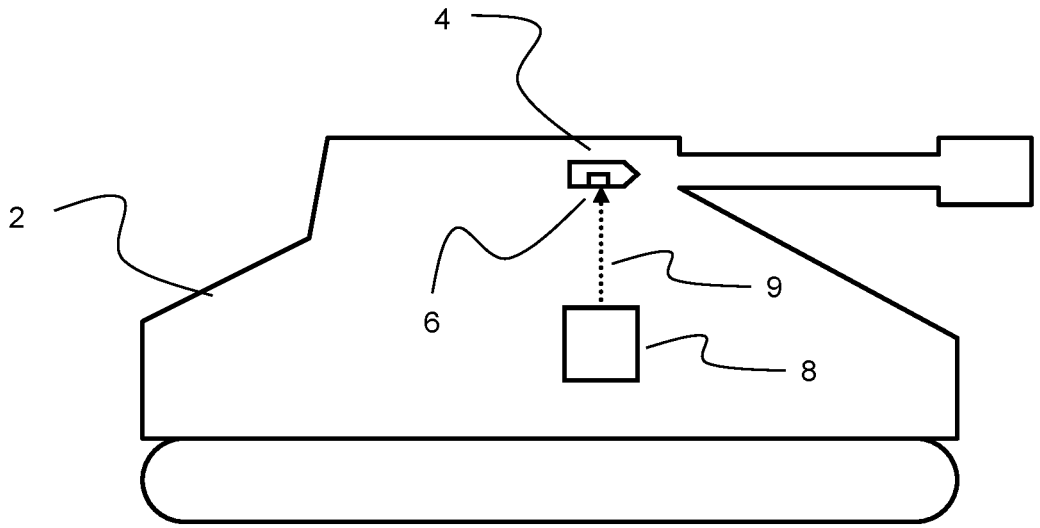

| | | | | |
|---|---|---|---|---|
| 4,091,734 | A | 5/1978 | Redmond et al. | |
| 7,591,225 | B1 * | 9/2009 | Cope | F42C 11/002 102/221 |
| 8,916,809 | B2 * | 12/2014 | Rastegar | F41G 7/007 244/3.1 |
| 2003/0159609 | A1 * | 8/2003 | Rauscher, Jr. | F42D 1/045 102/217 |
| 2008/0307993 | A1 * | 12/2008 | Chan | F42B 3/121 102/214 |
| 2020/0284569 | A1 * | 9/2020 | Feda | F42C 11/04 |

OTHER PUBLICATIONS

International Search Report and Written Opinion received for PCT Application No. PCT/GB2018/050291. Dated Mar. 28, 2018. 14 pages.

Extended European Search Report received for EP Application No. 17275014.3, dated Jul. 21, 2017. 10 pages.

GB Search Report under Section 17(5) received for GB Application No. 1702119.7, dated Jul. 26, 2017. 3 pages.

* cited by examiner

FUZE SYSTEM

The present invention relates generally to a fuse system, and more particularly to a fuse system for use in a munitions projectile.

Certain fuse (sometimes referred to as "fuze") systems for munitions projectiles, for example those requiring or implementing some form of course-correction or data-based activation, require setting data to be stored on an electronic memory within the fuse system so that the data can be recovered and used once the munitions projectile has been fired.

Typically, though, and for reasons of safety, electrical power is not normally available within the fuse system prior to firing of the munitions projectile and so power must be supplied from an external source in order to appropriately power the memory during setting. The supply of power is commonly achieved via inductive transfer of energy from outside of the fuse system and outside of the munitions projectile, to the fuse system within the munitions projectile. Alternatively, hard-wired connections might be used for the transfer of power, for example in the form of plug and socket like arrangements, or contact pins, and so on. However, a hard-wired approach is generally considered to be less desirable and more impractical than the inductive transfer of power.

For reasons of safety, it is highly desirable that the one or more electrical power supplies driving the setting of the memory device or powering one or more components of the fuse system itself are electrically isolated from one another. Such electrical isolation is implemented to reduce the risk that electrical power provided to set the memory of the fuse system could inadvertently be fed to an initiating device of the fuse system, which could inadvertently active the fuse itself. For instance, this inadvertent initiation of the fuse could occur under a fault condition, and limiting or avoiding this risk limits or avoid the risk of premature initiation of the munitions projectile.

Currently, such electrical isolation is provided by one or more semiconductor diodes or similar, to prevent power being transferred from setting circuitry or the like to the rest of the electronics within the fuse system, for example the initiating device or related components. However, it is feasible under some conditions that these diodes could pass some electrical current, and therefore present a hazardous condition. Such conditions might include or related to manufacturing defects, elevated temperatures (e.g. intrinsic conduction), excessive voltages on the settings side (e.g. leading to reverse voltage breakdown), and so on.

It is in an aim of example embodiments of the present invention to at least partially reduce or avoid one or more disadvantages of the prior art, discussed above or elsewhere, or to at least provide a viable alternative to existing fuse systems.

According to a first aspect of the present invention, there is provided a fuse system for a munitions projectile, the system comprising: a first electro-optic transmitter; a first electro-optic receiver; the first electro-optic transmitter being arranged to receive electrical power, and to use that received electrical power to transmit an optical signal to the first electro-optic receiver; the first electro-optic receiver being arranged to receive the optical signal, and to use that received optical signal to transmit electrical power to an element of the fuse system connected to the first electro-optic receiver.

The first electro-optic receiver may comprise a photovoltaic element, and/or the first electro-optic receiver may optionally be capable of acting as a low impedance current source.

The first electro-optic transmitter may be arranged to receive power from a power source external to the fuse system.

The element may only able to receive power derived from the power source external to the fuse system via the optical signal sent via the first electro-optic transmitter and first electro-optic receiver.

The element may be a memory element of the fuse system, for use in setting of a fuse of the fuse system.

The fuse system might further comprise a second electro-optic transmitter. The second electro-optic transmitter may be arranged to receive electrical power, and to use that received electrical power to transmit an optical signal to the first electro-optic receiver. The first electro-optic receiver may be arranged to receive the optical signal, and to use that received optical signal to transmit electrical power to the element of the fuse system connected to the first electro-optic receiver.

The second electro-optic transmitter may be arranged to receive power from a power source of the fuse system.

The element may only able to receive power derived from the power source of the fuse system via the signal sent via the second electro-optic transmitter and first electro-optic receiver.

The power source of the fuse system may be in direct electrical connection with a fuse activator and/or fuse of the fuse system, such that the fuse activator and/or fuse is able to be electrically powered without use of an electro-optic transmitter and/or receiver.

The element may be a memory element of the fuse system, for use in setting of a fuse of the fuse system. The fuse system might further comprise a data line connecting the memory to the fuse activator and/or fuse of the fuse system. The data line might optionally comprise an opto-coupler.

The first electro-optic transmitter and the first and/or second electro-optic receivers are substantially optimised for power transfer, optionally as opposed to only data transfer.

The fuse system might further comprises a power source, and the fuse system may be arranged such that the power source can only be used during or after a firing of a munitions projectile comprising that fuse system.

According to a second aspect of the present invention, there is provided a munitions projectile comprising the fuse system of the first aspect of the invention.

According to a third aspect of the present invention, there is provided a method of controlling an element of a fuse system for a munitions projectile, the method comprising: receiving electrical power; using that received electrical power to transmit an optical signal; receiving the optical signal; and using that received optical signal to transmit electrical power to an element of the fuse system.

The method might further comprise: receiving second electrical power from a power source of the fuse system; using that second received electrical power to transmit a second optical; receiving the second optical signal; and using that second received optical signal to transmit electrical power to the element of the fuse system According to a fourth aspect of the present invention, there is provided a transformer comprising: one or more first electro-optic transmitters; one or more first electro-optic receivers; the one or more first electro-optic transmitters being arranged to receive electrical power, and to use that received electrical power to transmit one or more optical signals to the one or more first electro-optic receivers; the one or more first electro-optic receivers being arranged to receive the one or more optical signals, and to use those received one or more optical signals to transmit electrical power to an element connected to the one or more first electro-optic receivers; the first electro-optic transmitter and the first electro-optic receiver are substantially optimised for power transfer, optionally as opposed to only data transfer.

According to a fifth aspect of the present invention, there is provided a munitions projectile comprising the transformer of the fourth aspect of the invention.

According to a sixth aspect of the present invention, there is provided a method of powering an element, the method comprising: receiving electrical power; using that received electrical power to transmit an optical signal; receiving the optical signal; and using that received optical signal to transmit electrical power to the element, the transmitting and receiving being substantially optimised for power transfer, optionally as opposed to only data transfer.

It will be generally understood by the skilled person that one or more features described in relation to any one particular aspect of the present invention may be used in place of or in combination with a feature of another, different aspect of the present invention, unless this would be considered mutually exclusive by the skilled person from a reading of this disclosure. For instance, the features described in relation to the fuse system could be used in place of or in combination with features of the transformer, or the other way round. Of course, any features described in relation to the system or transformer can be used in an associated munitions projectile including such a system or transformer, or a related method.

Figure 2:
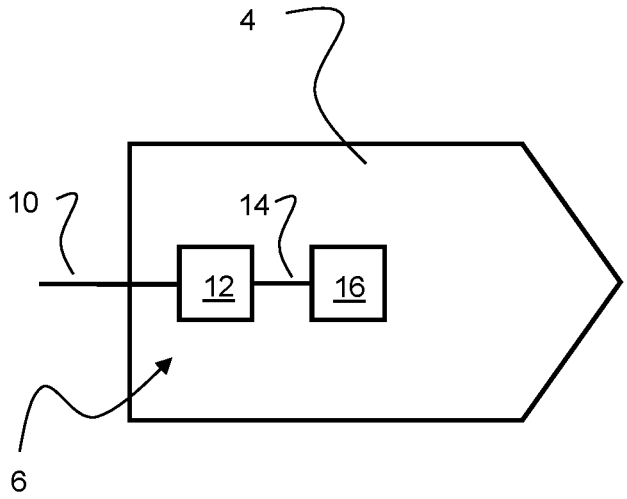
Figure 3:
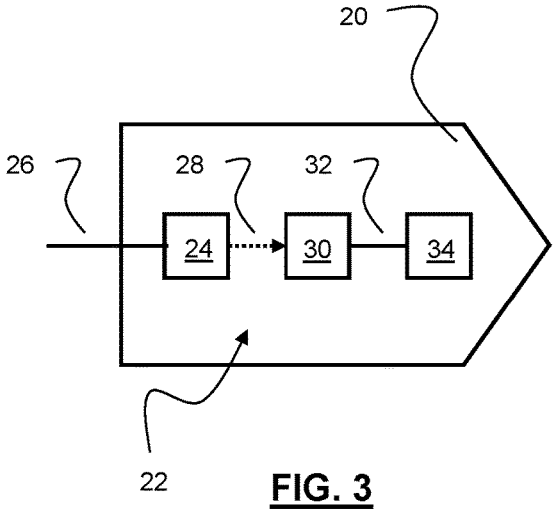
Figure 4:
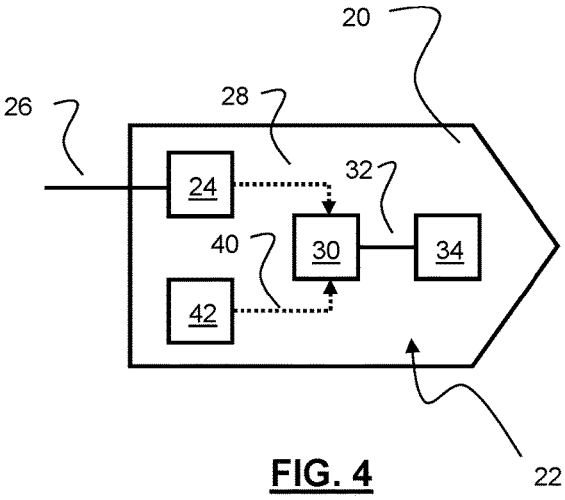
Figure 5:
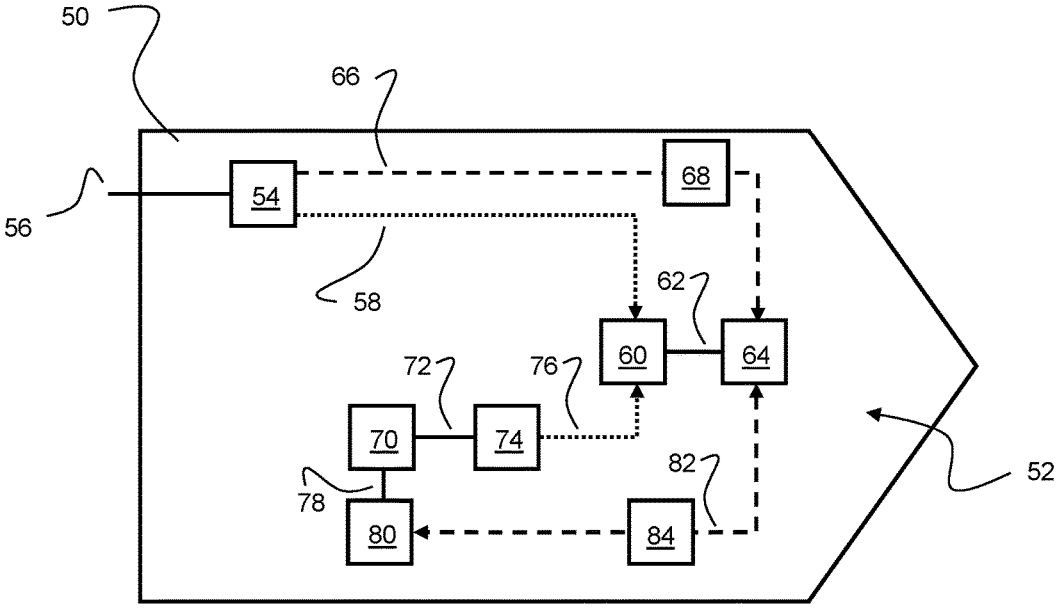
Figure 6:
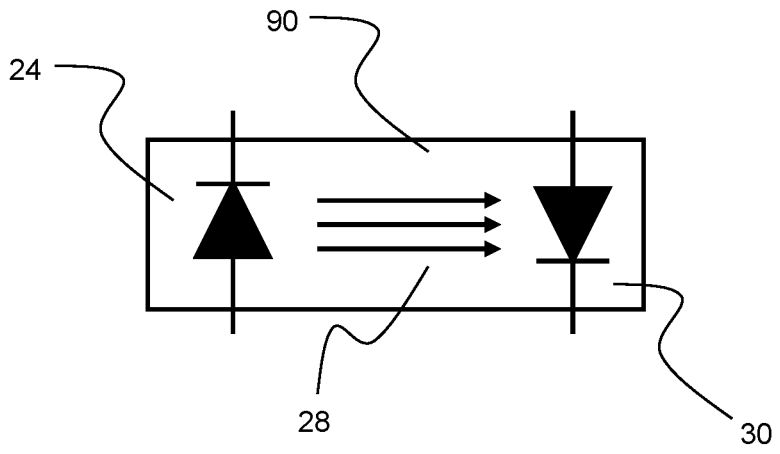
Figure 7:
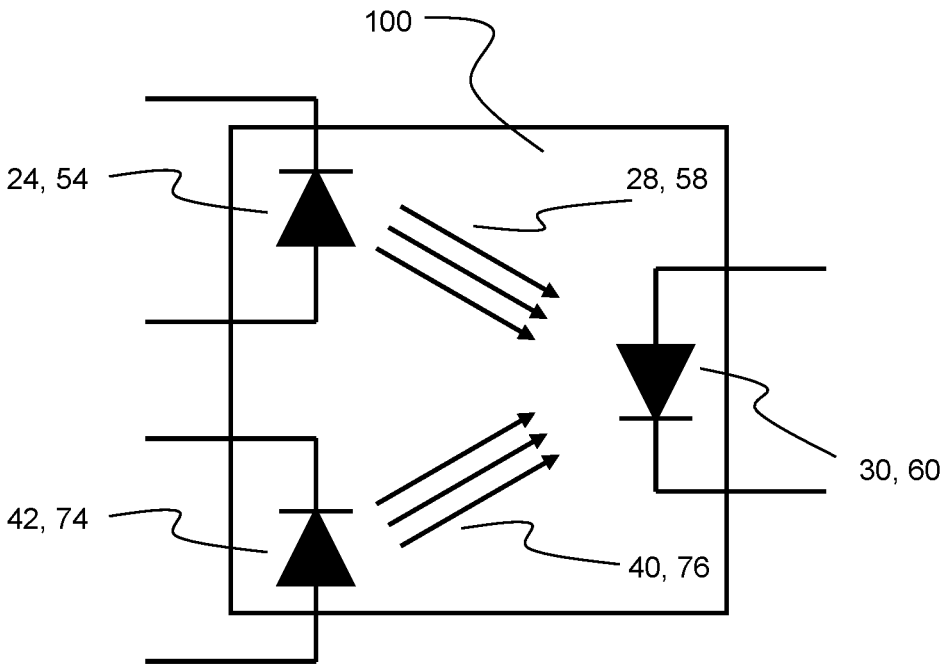
Figure 8:
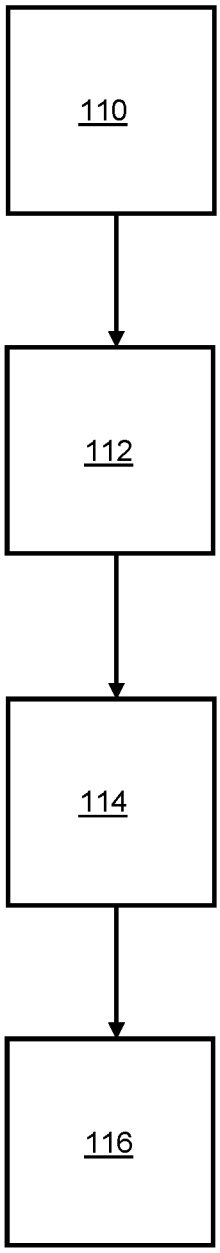

For a better understanding of the invention, and to show how embodiments of the same may be carried into effect, reference will now be made, by way of example, to the accompanying diagrammatic Figures in which:

FIG. 1 schematically depicts setting of a fuse of a munitions projectile prior to firing of the munitions projectile from a vehicle;

FIG. 2 schematically depicts an existing fuse system of a munitions projectile;

FIG. 3 schematically depicts a fuse system according to an example embodiment;

FIG. 4 schematically depicts a fuse system according to another example embodiment;

FIG. 5 schematically depicts a fuse system according to another example embodiment;

FIGS. 6 and 7 schematically depict more detail associated with the sorts of fuse systems shown in FIGS. 3 to 5; and FIG. 8 schematically depicts general methodology associated with an example embodiment.

FIG. 1 schematically depicts a military vehicle 2 capable of firing a munitions projectile 4. The munitions projectile 4 is provided with a fuse system 6. The vehicle 2 may comprise a setter or similar 8 for use in transmitting 9 fuse setting data and/or electrical power to the fuse system 6 of the munitions projectile 4. The data might comprise programming or tasking information or similar, and for example might include ranging information, course setting or correction information, and so on.

FIG. 2 schematically depicts a simplified version of a fuse system which might typically be found within an existing munitions projectile. The munitions projectile 4 is shown as receiving power 10 in a wired or wireless manner. A power reception element 12 is shown as being connected in a hard-wired manner 14 to other components of the fuse system generally depicted by box 16. The distribution of power received by reception element 12 to other components of the fuse system 16 might be appropriately controlled or otherwise filtered or restricted, as described above, by diodes or similar. For instance, these diodes might be in place to prevent power received at the reception element 12 from being passed to a fuse initiator or the fuse itself, or at least being passed at certain times. For instance, the diodes might be used to prevent supply of power to a fuse initiator or fuse when the munitions projectile 4 is receiving power from external 2 to the munitions projectile 4, and/or when the munitions projectile 4 is located within or proximal to an object or vehicle from which the projectile 4 has been, or is to be fired. The aim of this is to prevent unintentional, dangerous activation of the fuse.

As described above, however, diodes may, under certain conditions, still pass some electrical current and so present a potential flaw in the system. For instance, manufacturing defects, elevated temperatures, excessive voltages on the setting side, or other circumstances, could cause current to pass through the otherwise blocking diode, which could result in initiation of the fuse and detonation or burst of the munitions projectile in an unintentional manner.

It has been realised that the above problems can be reduced, or avoided, by the use of optical power supply isolation. That is, as opposed to filtering or blocking or otherwise controlling the power distribution throughout the fuse system using diodes or similar, at least in some circumstances the use of optical power supply isolation, for example using one or more opto-couplers, may be significantly advantageous. This optical approach is particularly advantageous, and finds synergy with, the field of fuse systems for munitions projectiles. This is because unintentional power supply to components might not simply be inconvenient, inefficient, or damaging to one or more components of a system, but could result in activation of the fuse and therefore potential loss of life to personnel in the vicinity of the related munitions projectile.

It has also been realised that while the use of opto-couplers (or similar) might be particularly advantageous in fuse systems, the same opto-couplers or related arrangements could be used to transfer power in an optical manner in a more general sense, for example forming an optical-based transformer. Many of the principles associated with the fuse system will be common with or overlap with features of the related transformer aspect, as will be apparent from the discussions below.

FIGS. 3 and 4 schematically depict use of opto-couplers within the fuse system of a munitions projectile in various simplified forms, to provide broad examples of the broad advantages associated with the use of such opto-couplers.

FIG. 3 schematically depicts a munitions projectile 20 according to an example embodiment. The munitions projectile 20 comprise a fuse system 22. The fuse system comprises a first electro-optic transmitter 24. The first electro-optic transmitter 24 is arranged to receive electrical power, for example from external 26 to the munitions projectile 20, via hard wiring or induction, and to use that received electrical power 26 to transmit 28 an optical signal to a first electro-optic receiver 30. The first electro-optic receiver 30 is arranged to receive the optical signal 28, and to use that received optical signal 28 to transmit electrical power 32 to an (e.g. another) element of the fuse system 34 connected to the first electro-optic receiver 30.

The element 34 may be any appropriate element of the fuse system 22, but will typically be an element of the fuse system that needs to be accessed or otherwise controlled by more than one other part of the fuse system or related or associated components connected to those parts, and associated different power supplies (e.g. an on-board memory, discussed below). This is so that different power flows or supplies to that element is or are isolated to prevent power inadvertently being directed along one or more unintentional routes. This will become clearer as the invention is described in more detail below.

It is important to note that not all opto-couplers (electro-optical transmitters, receivers) are necessarily ideal or preferred for use in the described embodiments. For example, opto-couplers having photo-transistor based receiving elements typically require a power source on the receiving side, and are more typically associated with data and not power transfer/isolation. Therefore, photodiode receivers, which will actually generate power on the receiving side, are preferred for use in the described embodiments. Additionally, photodiodes that operate in the photovoltaic mode as opposed to photo-conductive mode are likely to be of greater benefit, again since a separate power supply on the receive side would then not be required. In other words, only photovoltaic modes are capable of acting as a current source (e.g. as in solar panels), whereas other types simply act to modulate an existing supply current and hence do not actively transfer or supply any power. That is, the embodiments described herein are typically dealing with the transfer of power, and related isolation, as opposed to the transfer of data. Therefore, the receiving side of the one or more opto-couplers that are used in conjunction with example embodiments are used for generating power and, typically, being capable of acting as a low impedance current source (e.g. less than 1 MOhm, although in reality this is course a function of the load that is trying to be driven so there is arguably no meaningful boundary). Conversely, opto-couplers used in data transfer typically have the opposite impedance, that is a very high source impedance, and so cannot supply very much (or any) current. Essentially, signals tend to be voltage based and typically feed into a high impedance input (i.e. virtually no current is drawn, so virtually no power is transferred), where the signal voltage and current can then be amplified if desired using the receiving system's power supply. On the other hand, for powering components, as described herein, you need to supply appropriate levels of voltage and current directly from the receiver. In other words, the only supply of power on the receive side of the system, and capable of powering the element, is the electro-optic receiver.

FIG. 4 schematically depicts an advance on the simpler embodiment of FIG. 3. Specifically, in addition to the component show in FIG. 3, FIG. 4 shows that the first electro-optic receiver 30 may additionally receive power via a different route from that shown in FIG. 3. This additional power supply is by reception of another optical signal 40 from a different component or set of components 42 of the fuse system 22, which might include an electro-optic transmitter, as well as an internal power supply, and/or sensitive fuse activation or initiation components, including the fuse itself.

In basic terms, then, FIG. 4 shows how the element 34 can be appropriately powered via the external 26 power supply route, or for example via an internal 42 power supply route, when at the same time ensuring that the external 26 and internal 42 routes cannot in any way electrically interfere with one another. This means, for example, that it is not possible to transfer power between the two power supplies/routes. In other words, the element 34 can only receive power externally via an opto-coupler, or internally via an opto-coupler, thus ensuring true power isolation within the fuse system of the munitions projectile, overcoming or avoiding the problems described above.

FIG. 4 schematically depicted power supply from different routes, and isolation between these routes, in a simplified form. FIG. 5 schematically depicts in more detailed a practical implementation of the sort of system shown in and described with reference to FIG. 4.

Referring to FIG. 5, there is shown a munitions projectile 50 according to another example embodiment. The munitions projectile 50 comprises a fuse system 52, for example for use in detonating or bursting or otherwise activating in some way the munitions projectile 50.

A first electro-optic transmitter 54 is arranged to receive electrical power from external 56 to the munitions projectile 50, for example via the wired, connector, or induction systems mentioned above. The first electro-optic transmitter 54 is arranged to receive that electrical power 56 and to use that power 56 to generate and transmit an optical signal 58 to a first electro-optic receiver 60. The first electro-optic receiver 60 is, in turn, arranged to receive the optical signal 58, and to use that received optical signal 58 to generate and transmit 62 electrical power to an element 64 of the fuse system 52 connected to the first electro-optic receiver 60. This approach allows the external supply of power 56 to be electrically isolated from the power that is ultimately supplied to the element 64, via the opto-coupling or in other words opto-isolator (in the form of the first electro-optic transmitter 54 and receiver 60).

As well as being provided with power 62, the element 64 may be provided with and/or transmit data via a data line 66 to/from external to the munitions projectile 50. Although this data line 66 does not transmit a significant amount of power, for example enough to actually power the element 64, it might still nevertheless be useful to include an opto-coupler 68 in or along the data line 66 to, again, electrically isolate the element 64 from one or more electrical power supplies. The additional or optional opto-coupler 68 is only shown generically in FIG. 5, but it will be appreciated that this will take the form of at least one electro-optic transmitter and receiver as shown in and described with reference to other embodiments described herein. The data line 66 is also shown as being connected to the first electro-optic transmitter 54, but in practice the data line 66 may be connected to another component, or the box 54 may depict the first electro-optic transmitter 54 and additional circuitry, for example data processing or generating circuitry.

As already discussed above, the element 64 may be a memory element 64 of the fuse system, for example for use in setting a fuse of the fuse system 52. So, the supply of power discussed so far in relation to FIG. 5 may be, for instance, used or employed prior to firing of the projectile 50, for example for use in setting or programming the memory 64 for use in subsequent activation of the fuse of the system, to be described in more detail below. This approach avoids the use of an internal power supply of the fuse system prior to firing, which could be dangerous.

The memory could be any suitable memory, for example non-volatile memory types including FLASH memory, FRAM, MRAM etc. FRAM and MRAM types are preferred as they offer fast read/write operations combined with low power consumption.

Another part of the fuse system 52 comprises an internal power supply or power source 70. For safety reasons, at least, it is desirable to ensure that the internal power supply 70 is not used, or usable, prior to firing of the munitions projectile 50. This can be achieved in a number of ways, via one or more inertially activated switches or controllers, or by configuring the power supply 70 itself such that it does not or cannot provide power until the projectile 50 has been fired. For example, in accordance with this latter option, the power supply 70 can be configured such that it is not in a physical or chemical state that is able to provide electrical power until the projectile 50 is in a fired and spinning state, which could physical or chemically alter the power supply 70 such that this then able to provide or supply electrical power. Such schemes are known, and so are not discussed in any further detail.

The internal power supply 70 is arranged to transmit electrical power 72 to a second electro-optic transmitter 74. This second electro-optic transmitter 74 is arranged to receive that power, and to generate and transmit an optical signal 76 to the first electro-optic receiver 60. That receiver 60 is then arranged to receive that transmitted optical signal 76, and to generate electrical power from that received signal 76 for transmission 72 to the element 64, as described above.

The same internal power supply 70 may be used to power 78 the fuse or related fuse initiator or activator 80 of the system, for ultimate use in detonating or bursting the projectile 50. This power supply can be hard wired, and not supplying power via an opto-coupler. The fuse or fuse activator or initiator 80 can be provided with and/or access data from the memory 64 via a data line 82. The data line, as described above, comprises an optional opto-coupler or isolator 84. Data might need to be accessed after firing, for example in order to ensure that the fuse is activated at a certain time or location.

It can be seen from FIG. 5 that there are two power supply systems in operation, one for use prior to firing of the projectile 50, provided externally 56, and one for use after firing of the projectile 50, which can be provided by internal power supply 70. Importantly, while both power supplies can be used to appropriately power the memory element 64 of the fuse system 52, neither power supply nor associated wired components can in any way at all provide electrical power to the other power supply route or associated circuitry. Specifically, the external 56 power supply route cannot in any way provide electrical power to the internal power supply route or related circuitry 70, and the internal power supply 70 cannot in any way provide electrical power to the external electrical power supply route 56 or related circuitry. Perhaps most importantly, this means that the external power supply 56 cannot in any way be used to provide electrical power, intentionally or otherwise, to the fuse, or fuse activator or initiator 80 of the fuse system 52 of the munitions projectile 50. This means that it is simply not possible to inadvertently activate or initiate the fuse via the external power supply route 56, increasing the safety of the munitions projectile 50. All this is made possible because the electro-optic receiver 60 only ever receives and generates power, but cannot optically transmit power, thereby ensuring isolation of the transmit end of the power supply routes. Similarly, or conversely, only electro-optic transmitters 54, 74 cannot receive and generate power from an optical source, meaning that these part of the circuit cannot in any way receive electrical power from another route, again ensuring power supply isolation.

FIG. 6 shows, in more detail form, how power transfer might be achieved via an electro-optic transmitter and an electro-optic receiver. Using the arrangement shown in and described with reference to FIG. 3 as a first example, FIG. 6 shows that the first electro-optic transmitter 24 might be an appropriate light emitting diode or laser diode for converting electrical power to light. The optical signal 28 that is ultimately transmitted by the first electro-optic transmitter 24 may then be received via the first electro-optic receiver 30 which may take the form of a photodiode operating in photovoltaic mode. The transmitter 24 and receiver 30 will, of course, be in optical communication with one another but are otherwise isolated. The isolation might be with respect to one another in terms of electrical coupling or similar, but might also be isolation with respect to the general external environment by way of an appropriately configured housing 90. Housing 90 could be a chamber or similar, or a material in which the transmitter 24 and receiver 30 are embedded. Such isolation may therefore ensure that the transmitter and receiver are not only electrically isolated from one anther, but at the same time being immune to external optical interference or similar. That is, the housing 90 could be optically opaque to, or at leas partially block, wavelengths of electromagnetic radiation that the receiver 30 is sensitive to.

FIG. 7 schematically depicts a similar arrangement, and similar operating principals, to those shown in relation to FIG. 6, but now used to represent the more advanced systems of FIG. 4 or 5. All transmitters 24, 54, 42, 74, and receivers 30, 60 may be located within the same housing 100, for the reasons already described above.

As stressed above, one of the main purposes of embodiments of the present invention is that useful power is transferred from electro-optic transmitter to electro-optic receiver. This is opposed to simple data transfer where power transfer, or efficiency of power transfer, is not important or possible. So, in accordance with example embodiments, the transmitters and/or receivers might be particularly optimised for power transfer. This might be used in combination with different configurations of input (transmit) and output (receive) electro-optic components such that the components serve as an optical transformer.

The use of multiple series or parallel coupled transmission and/or receiving elements or devices could allow voltage levels to be shifted up or down in the manner of an electrical transformer, but since the power transfer would be undertaken optically, there would be little or no electromagnetic interference generated by such an optical transformer, which may be advantageous for the reasons described above. That is, the reduction or elimination of electromagnetic interference might prevent one or more other components of the fuse system being interfered with or inadvertently initiated. A selection of suitable series/parallel array designs could allow the voltage and current input/output to be matched as required.

Whilst the overall power transfer efficiency of example embodiments might still be considered to be relatively modest compared with direct electrical connection, there are still a number of advantages associated with optical power transfer/isolation compared with electrical isolation/transformers. For example, an electrical device can work directly from a DC power source, whereas conventional transformers require an alternating current. An optical based device does not emit, and it not affected by, electromagnetic interference, whereas electrical transformers do emit, and can be affected by electromagnetic interference. In optical embodiments, the physical separation between transmission and receiving elements or devices can be increased, providing very high levels of electrical isolation. At the same time, the transmitter and receive components or devices can be located within a single housing, or in or on a single chip (i.e. together forming or being part of a single unit or package), keeping the overall system compact. Also, as discussed above, the optical devices described are inherently one-way, in that no significant (or any) energy transfer pathways are available for reverse operation (e.g. no back EMF or cross-coupling is possible, as is the case with conventional electrical transformers with windings). Additionally, the lack of large numbers of metallic windings and magnetic core materials mean that optical-based devices can potentially be both smaller and lighter than their winding-base counterparts. Also, optical devices may be suitably based on solid-state electronics and hence can be made physically robust enough to survive harsh operation environments often found in, for instance, munitions.

The optimisation of power transfer can be achieved in a number of different ways, in isolation or combination. For example, in existing arrangements where optical-coupling is used simply for data transfer, the efficient use or transfer of power is not a concern. So, in existing devices there might be a situation where a forward voltage for a transmitting LED is approximately 1.4V. Assuming that, for instance, this was driven by a 12V power source, 10.6V would need to be dropped across a resistor or similar. So, there is clearly no optimisation for power transfer in this example. In contrast, in accordance with example embodiments, the number, type or nature of the emitting LEDs can be configured to better match the power supply. For instance, in the aforementioned example, if you had 8 LEDs in series, you would be able to create 8 times the optical transmission power, and only have to drop 0.57V across a resistor or similar. Therefore, the input side of the arrangement has been suitably optimised for power transfer, rather than transfer of signals. In another example, the power supply could be tuned to the forward voltage of the LEDs.

In another example of optimisation, laser diodes could be used, having a typically operating forward voltage of 2V each. If used instead of LEDs, then an array of 6 laser diodes in series could be used to maximise the available power supply voltage of 12V. The electrical-to-optical conversion efficiency of laser diodes is also higher than LEDs (approximately 30-70% with later diodes, compared with 10-30% of LEDs), so further optimisation is available here, too.

Many silicon photodiodes are most sensitive (and hence efficient) at around 890 nm. Therefore, matching the output wavelength of the light emitting diode or laser diode provides another means of optimisation for power transfer. For instance, LED outputs tend to cover a wider spectrum (typically 10 nm) whereas laser diodes have much narrower emission spectra (typically less than 10 nm). Use of laser diodes may therefore provide improved energy efficiency, since most of the optical output can be matched to the most receptive range of the photodiode. Also, laser diodes with output wavelengths of approximately 890 nm are available commercially at modest costs. Of course, other photodiodes/materials may operate at different wavelengths.

If a lower output voltage was required, for example 6V, then approximately 10 series connected photodiodes could be used. If a large number of emission devices were used then a large number of series connected arrays of photodiodes can be connected in parallel, in order to increase the optical capture area and hence increase the output current at the same voltage. In other words, a photovoltaic array could be used.

It will be appreciated, then, that power transfer can be optimised in one of a number of different ways, for example matching transmission and reception wavelengths or sensitivities, by matching or optimising the number or type of nature of transmitting photodiodes or other electro-optic transmitters to the available power supply, and so-on. Generally, it will be understood by one of ordinary skill in the art that the overall opto-coupler, or in other words electro-optic transmitter and receiver, may be optimised for power transfer, as opposed to simply signal transfer.

From the description provided above, it will be understood that many of the principles described in relation to the fuse system comprising a first electro-optic transmitter and a first electro-optic receiver (or similar) may therefore be applied to, or overlap with, the principles associated with an optical transformer or similar.

Referring to FIG. 8, a simple methodology associated with example embodiments is shown, specifically a method controlling an element of a fuse system for a munitions projectile. The method comprises receiving electrical power 110 (e.g. external to the fuse system/munition). That received electrical power is then used to transmit an optical signal 112. That transmitted electrical signal is then received 114. The received optical signal is then used to generate and transmit electrical power to the element of the fused system 116.

The method might further comprise: receiving second electrical power from a power source of the fuse system (e.g. internal to the system); using that second received electrical power to transmit a second optical; receiving the second optical signal; and using that second received optical signal to transmit electrical power to the element of the fuse system. Again, an advantage is that the power systems are decoupled. That is, there is galvanic isolation between any power system or supply and the element, and galvanic isolation between different power systems or supplies.

The embodiments described so far have focused generally on fuse systems, munitions, and so on. However, the invention, or specific embodiments, might find more general application. For example, the invention might more generally be used to electrically (e.g. galvanically) isolate an element to be powered from its power supply, and/or generally be used to electrically (e.g. galvanically) isolate an element to be powered from different power supplies, and/or generally be used to electrically (e.g. galvanically) isolate different power supplies that are to be used to power an element. In these broader examples, the invention might not be defined or described as a fuse system comprising or using such power supply systems and/or related methodology, but may instead be described or define more generally as a power supply system, or power supply method, for use in powering an element. The element will vary according to the application in question, but the benefits described above are still realised.

Such a more general power supply system might be described as comprising: a first electro-optic transmitter; a first electro-optic receiver; the first electro-optic transmitter being arranged to receive electrical power, and to use that received electrical power to transmit an optical signal to the first electro-optic receiver; the first electro-optic receiver being arranged to receive the optical signal, and to use that received optical signal to transmit electrical power to an element of the system connected or connectable to the first electro-optic receiver. The system might further comprise a second electro-optic transmitter; the second electro-optic transmitter being arranged to receive electrical power, and to use that received electrical power to transmit an optical signal to the first electro-optic receiver; the first electro-optic receiver being arranged to receive the optical signal, and to use that received optical signal to transmit electrical power to the element connected or connectable to the first electro-optic receiver; and wherein the second electro-optic transmitter is arranged to receive power from a power source of the system.

Such a more general power supply method might be described as comprising: receiving first electrical power; using that first received electrical power to transmit a first optical signal; receiving the first optical signal; and using that first received optical signal to transmit electrical power to an element of or at least connectable to the system. The method might further comprise: receiving second electrical power from a power source of the system; using that second received electrical power to transmit a second optical; receiving the second optical signal; and using that second received optical signal to transmit electrical power to the element.

The embodiments might find particular use in munitions projectiles, where inadvertent power supply to a particular component could prove fatal. However, the embodiments will find other uses in applications where power supply isolation is required.

Although a few preferred embodiments have been shown and described, it will be appreciated by those skilled in the art that various changes and modifications might be made without departing from the scope of the invention, as defined in the appended claims.

Attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

The invention claimed is:

1. A fuse system for a munitions projectile, the system comprising:

a first electro-optic transmitter arranged to receive electrical power from a first power source external from the munitions projectile, and to use that received electrical power to transmit a first optical signal;

a second power source different from the first power source;

a second electro-optic transmitter arranged to receive electrical power from the second power source, and to use that received electrical power to transmit a second optical signal;

an electro-optic receiver arranged to receive the first optical signal and the second optical signal, and to use the received first optical signal and the received second optical signal to transmit electrical power to a power receiving element of the fuse system; and a fuse activator and/or fuse, wherein the second power source of the fuse system is hard wired to the fuse activator and/or fuse such that the fuse activator and/or fuse is configured to be electrically powered without use of an electro-optic transmitter and/or an electro-optic receiver.

2. The fuse system of claim 1, wherein the electro-optic receiver comprises a photovoltaic element.

3. The fuse system of claim 2, wherein the electro-optic receiver is configured to act as a low impedance current source.

4. The fuse system of claim 1, comprising the power receiving element, wherein the power receiving element is a memory element of the fuse system, and wherein the memory element is configured to set the fuse activator and/or fuse of the fuse system.

5. The fuse system of claim 1, comprising the power receiving element, wherein the power receiving element is a memory element of the fuse system and is configured to set the fuse activator and/or fuse, and the fuse system further comprises a data line connecting the memory element to the fuse activator and/or fuse of the fuse system.

6. The fuse system of claim 5, wherein the data line comprises an opto-coupler.

7. The fuse system of claim 1, wherein the first and second electro-optic transmitters and the electro-optic receiver are configured for power transfer.

8. The fuse system of claim 1, wherein the fuse system is arranged such that the second power source can only be used during or after a firing of the munitions projectile.

9. The fuse system of claim 1, wherein the fuse activator and/or fuse of the fuse system cannot receive any power from the first electro-optic transmitter.

10. The fuse system of claim 1, comprising the power receiving element, wherein the power receiving element is configured to receive power derived from the first power source only via the first optical signal and to receive power derived from the second power source only via the second optical signal.

11. A munitions projectile comprising the fuse system of claim 1.

12. A fuse system for a munitions projectile, the system comprising:

a first electro-optic transmitter arranged to receive electrical power from a first power source external from the munitions projectile, and to use that received electrical power to transmit a first optical signal;

a second power source different from the first power source;

a second electro-optic transmitter arranged to receive electrical power from the second power source, and to use that received electrical power to transmit a second optical signal;

an electro-optic receiver arranged to receive the first optical signal and the second optical signal, and to use the received first optical signal and the received second optical signal to transmit electrical power to a memory element connected to the electro-optic receiver; and a data line connecting the memory element to a fuse activator and/or a fuse of the fuse system, such that the memory element is configured to set the fuse activator and/or fuse of the fuse system via the data line, and wherein the second power source of the fuse system is hard wired to the fuse activator and/or fuse.

13. The fuse system of claim 12, wherein the memory element receives power derived from the first power source only via the first optical signal and receives power derived from the second power source only via the second optical signal.

14. The fuse system of claim 12, wherein the electro-optic receiver comprises a photovoltaic element.

15. The fuse system of claim 12, wherein the fuse system is arranged such that the second power source can only be used during or after a firing of a munitions projectile comprising that fuse system.

16. The fuse system of claim 12, wherein the data line comprises an opto-coupler.

* * * * *